US006216683B1

(12) United States Patent
Maughan

(10) Patent No.: US 6,216,683 B1
(45) **Date of Patent: *Apr. 17, 2001**

(54) GAS OVEN CONTROL

(75) Inventor: James Rollins Maughan, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/411,723

(22) Filed: Oct. 1, 1999

Related U.S. Application Data

(60) Division of application No. 08/954,011, filed on Oct. 20, 1997, now Pat. No. 6,030,205, which is a continuation-in-part of application No. 08/516,595, filed on Aug. 18, 1995, now Pat. No. 5,791,890.

(51) Int. Cl.[7] ..... F24C 3/12

(52) U.S. Cl. ..... 126/19 R; 431/6; 431/29; 431/70; 431/71

(58) Field of Search ..... 431/6, 75, 80, 431/18, 281, 12, 69, 70, 71, 29; 126/19 R, 39 E

(56) References Cited

U.S. PATENT DOCUMENTS

| | | | | |
|---|---|---|---|---|
| 4,402,663 | * | 9/1983 | Romanelli et al. | 431/66 |
| 4,480,986 | * | 11/1984 | Nelson et al. | 431/37 |
| 5,791,890 | * | 8/1998 | Maughan | 431/6 |
| 6,030,205 | * | 2/2000 | Maughan | 431/29 |

* cited by examiner

*Primary Examiner*—Carl D. Price
(74) *Attorney, Agent, or Firm*—Patrick K. Patnode; Marvin Snyder

(57) ABSTRACT

A gas oven comprises at least a first burner element disposed within an oven cavity of the gas oven. A first control valve is disposed within a gas line connected to the burner element and to a gas source. The control valve controls gas flow to the burner element. A first temperature sensor is positioned so as to detect temperature about the burner element. A controller is electrically coupled to the temperature sensor and to the control valve wherein the controller ensures successful ignition of the burner element by monitoring the temperature signals generated from the temperature sensor to determine if the temperature signals increase a rate that is greater than a predetermined.

13 Claims, 4 Drawing Sheets

GAS OVEN CONTROL

CROSS REFERENCE TO RELATED APPLICATION

This application is a division of application Ser. No. 08/954,011, filed Oct. 20, 1997, now U.S. Pat. No. 6,030, 205, which is a continuation-in-part of commonly assigned patent application Ser. No. 08/516,595, entitled "Gas Oven Fuel Control With Proof of Ignition," filed Aug. 18, 1995, now U.S. Pat. No. 5,791,890 which is incorporated herein by reference.

BACKGROUND OF THE INVENTION

This invention relates generally to gas ovens and more particularly to control and ignition systems for gas ovens.

Household gas ovens typically include at least a broil burner, typically positioned towards the top of an oven chamber, and a bake burner, typically positioned towards the bottom of the oven chamber. Conventional ignition systems for gas ovens typically include a hot surface ignitor, for example a glowbar, in conjunction with a thermally operated gas control valve. The thermally operated gas control valve opens so as to permit gas flow to the respective burner assembly only when a specified current has been established through the glowbar. The specified current corresponds to a glowbar temperature that will ignite the gas flow upon introduction.

Accordingly, a system user selects the type of gas oven operation needed, for example bake mode or broil mode, typically by manipulating a control knob. Once selected, the glowbar begins heating and the current increases until it reaches a steady state. After the current rises above the lower limit for ignition, the thermally operated gas control valve opens, the fuel is ignited, and a flame is established at the selected burner.

One current problem with the beforementioned ignition systems is cost. In the highly competitive household gas oven market, any unnecessary or excessive costs should be avoided. In the beforementioned ignition system both the thermostatic gas control valves and the hot surface ignitors are expensive components for a household gas oven system, and the hot surface ignitors are subject to frequent breakage. Additionally, misalignment of the hot surface ignitor relative to the thermostatic gas valve may delay or prevent burner ignition.

Another current problem with commercially available gas ovens is that once gas is issued through a burner element and an ignition attempt is made, there is no mechanism for ensuring the ignition attempt was successful. Additionally, even if the ignition attempt was successful, there is no mechanism for determining if there is a flameout at the burner element.

Therefore, it is apparent from the above that there exists a need in the art for improvements in safe, low cost gas oven ignition and detection systems.

SUMMARY OF THE INVENTION

A gas oven comprises at least a first burner element disposed within an oven cavity of the gas oven. A first control valve is disposed within a gas line connected to the burner element and to a gas source. The control valve controls gas flow to the burner element. A first temperature sensor is positioned so as to detect temperature about the burner element. A controller is electrically coupled to the temperature sensor and to the control valve wherein the controller ensures successful ignition of the burner element by monitoring the temperature signals generated from the temperature sensor to detect if the temperature signals increase at a rate that is greater than a predetermined ignition rate.

DETAILED DESCRIPTION OF THE INVENTION

Figure 1:
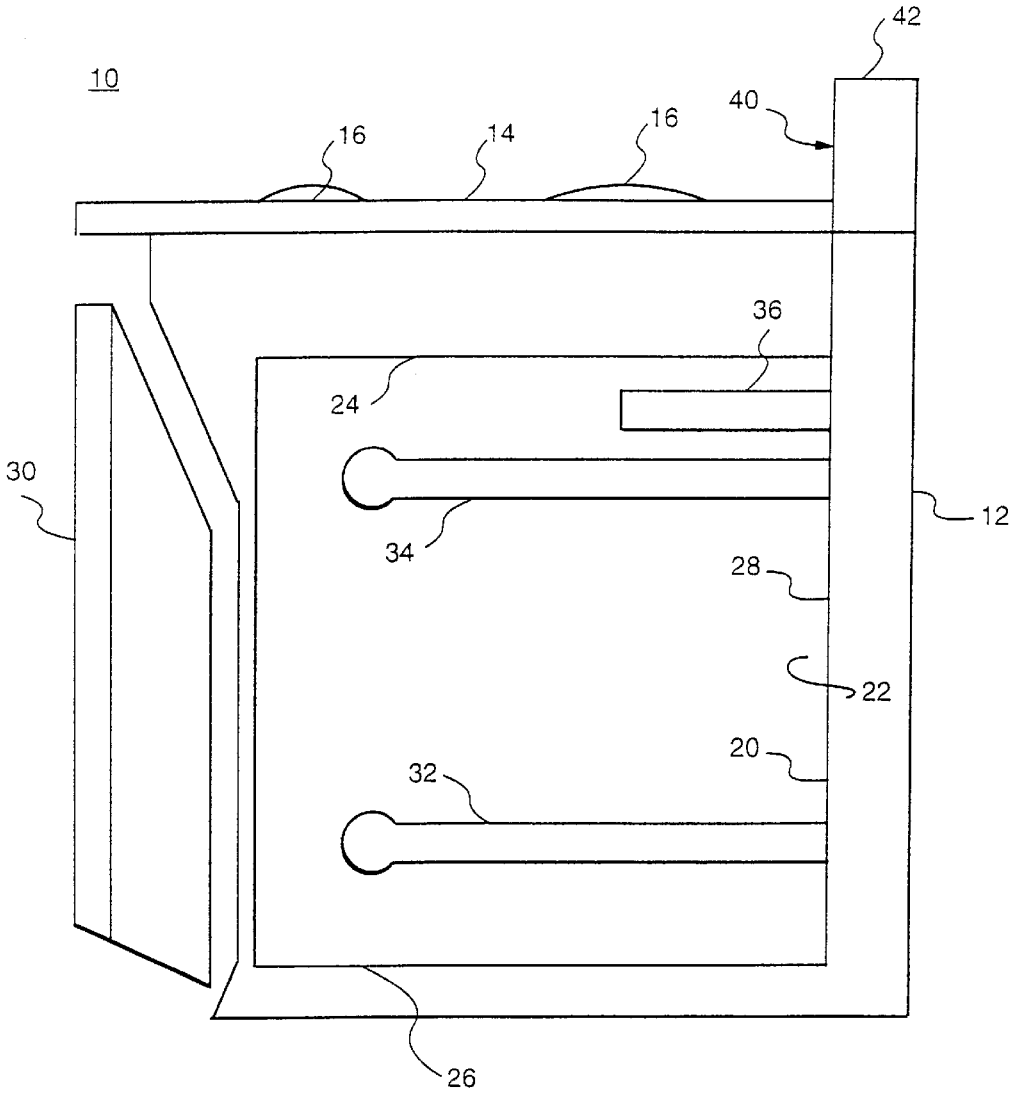
FIG. 1 is a fragmented side elevation view of an illustrative embodiment of the instant invention.

An exemplary embodiment of a gas oven 10 includes an outer cabinet 12 with a top cooking surface 14 having at least one individual surface unit 16, as shown in FIG. 1. Although the present invention is described herein in connection with gas oven 10, the present invention is not limited to practice with gas oven 10. In fact, the present invention can be implemented and utilized with many other configurations.

Positioned within cabinet 12 is a cooking chamber 18 formed by a box-like oven liner 20 having vertical side walls 22, a top wall 24, a bottom wall 26, a rear wall 28 and a front opening drop door 30. Cooking chamber 18 is provided with a bake element 32, typically positioned adjacent bottom wall 26, and a broil element 34, typically positioned adjacent top wall 24. Bake element 32 and broil element 34 typically comprise heating units such as resistance heat elements or the like.

A control knob 40 extends outwardly from a backsplash 42 of gas oven 10. Control knob 40 is provided such that a system-user can select the mode of operation for gas oven 10.

Figure 2:
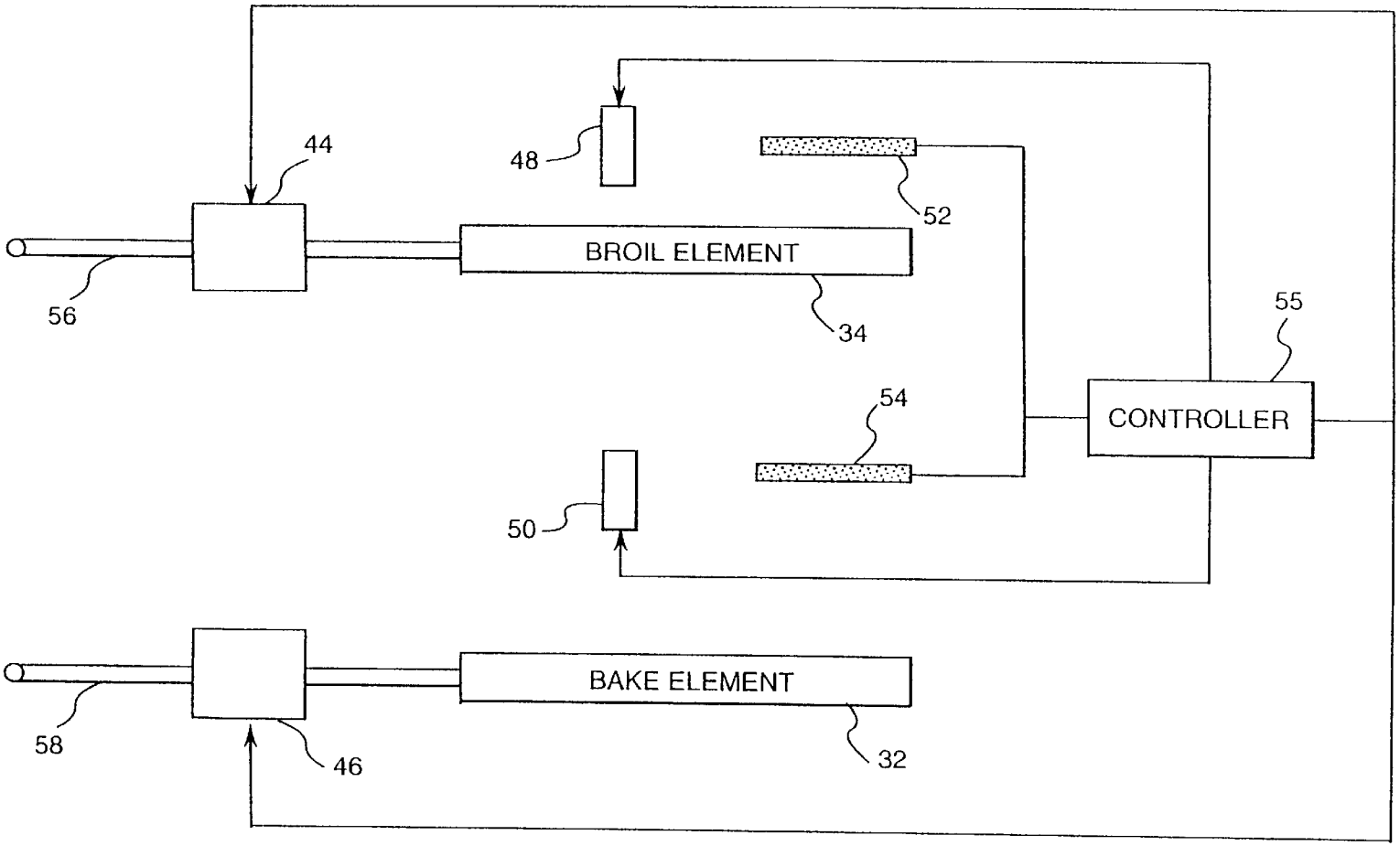
FIG. 2 is a schematic illustration of an ignition detection system in accordance with one embodiment of the instant invention.

Gas oven 10 further comprises a first control valve 44, a second control valve 46, a first ignitor 48, a second ignitor 50, a first temperature sensor 52 and a second temperature sensor 54, each of which are electrically coupled to a controller 55, as shown in FIG. 2.

First control valve 44, typically a solenoid valve, is disposed within a first gas line 56, which first gas line 56 connects a gas source (not shown) to broil element 34. Gas flow from the gas source is delivered to broil element 34 when first control valve 44 is disposed in an open position and conversely, gas flow is prevented to broil element 34 when first control valve 44 is disposed in a closed position. First ignitor 48 is positioned adjacent broil element 34 such that first ignitor 48 can provide ignition to the gas flow issuing from broil element 34 when first control valve 44 is disposed in an open position.

Second control valve 46, typically a solenoid valve, is disposed within a second gas line 58, which second gas line 58 connects a gas source (not shown) to bake element 32. Gas flow from the gas source is delivered to bake element 32 when second control valve 46 is disposed in an open position and conversely, gas flow is prevented to bake element 32 when second control valve 46 is disposed in a closed position. Second ignitor 50 is positioned adjacent bake element 32 such that ignitor 50 can provide ignition to the gas flow issuing from bake element 32 when second control valve 46 is disposed in an open position.

Temperature sensors 52 and 54 typically comprise thermocouples or the like. Temperature sensors 52 and 54 are positioned adjacent broil element 34 and bake element 32 respectively, so as to sense temperature about each element.

For purposes of clarity, the operation of gas oven 10 will be discussed in terms of a BAKE MODE and a BROIL MODE. Although the exemplary embodiments will be discussed in terms of a BAKE MODE and a BROIL MODE, the invention is not limited to these modes. In fact, the present invention can be implemented and utilized with many other modes of operation.

During operation, a system-user manipulation of control knob 40 (FIG. 1) to the corresponding position, inputs either BAKE MODE or BROIL MODE.

If the system-user selects BAKE MODE, a preset temperature ($T_s$) is established, typically in the range between about 100° F. and 550° F.

Controller 55 (FIG. 2) generates a control signal to open control valve 46 such that a flow of gas is established through gas pipe 58 and is issued through bake element 32. Additionally, controller 55 causes an ignition signal to be generated to activate ignitor 50 such that a spark or the like is generated by ignitor 50 to ignite the flow of gas issuing through bake element 32.

Controller 55 receives temperature signals from temperature sensor 54 so as to monitor the temperature and temperature change about bake element 32.

Controller 55 also receives temperature signals from a conventional oven thermometer 36 (FIG. 1) to monitor the overall oven temperature. If controller 55 (FIG. 2) senses from oven thermometer 36 that the oven temperature is greater than or equal to the preset temperature ($T_s$), heating is no longer required, and controller 55 generates a control signal to close control valve 46.

One current problem with commercially available gas ovens is that once gas is issued through a burner element and an ignition attempt is made, there is no mechanism for ensuring the ignition attempt was successful. Additionally, even if the ignition attempt was successful, there is no mechanism for determining if there is a flameout at the burner element.

In accordance with one embodiment of the instant invention, controller 55 ensures ignition attempts are successful by monitoring the temperature signals generated from temperature sensor 54. If the temperature signals generated by temperature sensor 54 increase at a rate that is greater than a predetermined ignition rate, the ignition attempt is determined to be successful.

In one embodiment, ignition is proven within 10 seconds of the opening of control valve 46 by detecting at least a 2.0 mV increase in the temperature signals generated by temperature sensor 54. In another embodiment of the instant invention, ignition is proven within 60 seconds of the opening of control valve 46 by detecting at least a 3 degrees Fahrenheit increase in the temperature signals generated by temperature sensor 54.

If the temperature signals sensed by temperature sensor 54 do not increase at a rate that is greater than a predetermined ignition rate, the ignition attempt is determined by controller 55 to have been unsuccessful, controller generates a control signal to close control valve 46, and oven cavity 18 (FIG. 1) is allowed to purge itself during a predetermined time delay before another ignition attempt is made. During the delay, unburned fuel leaves the oven cavity 18, and after the delay the ignition process is begun anew.

If controller 55 (FIG. 2) determines ignition was successful, controller 55 continues to monitor the temperature signals generated by temperature sensor 54 to detect if there is a premature flameout.

Controller 55 determines that there is a premature flameout if either, the temperature signals generated by temperature sensor 54 are decreasing at a rate that is greater than a predetermined flameout rate, or if the temperature signals generated by temperature sensor 54 are increasing at a rate that is less than a predetermined flame rate.

Figure 3:
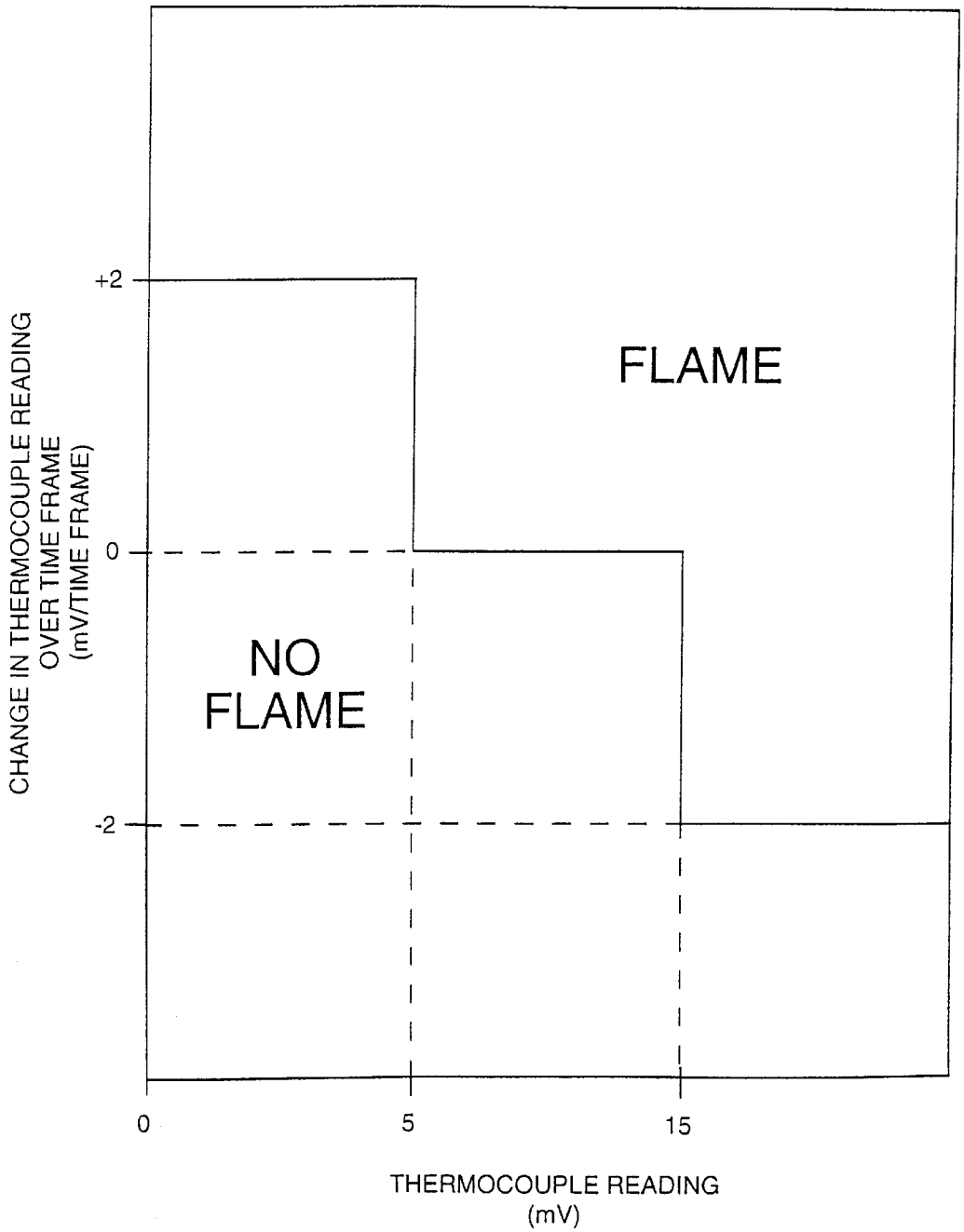
FIG. 3 is a graph showing a comparison of thermocouple readings and change in thermocouple readings in accordance with one embodiment of the instant invention.

In one embodiment, the temperature signals generated by temperature sensor 54 are monitored at one second intervals. Controller 55 compares each temperature signal to the temperature signal detected 14 seconds earlier. The change in the temperature signal over that time period is compared with predetermined criteria. One representative embodiment of the instant invention would correspond with predetermined criteria as displayed in FIG. 3 If the current temperature signal plotted against the change in the temperature signal, over the time period, maps above the plotted predetermined criteria (one example of which is shown in FIG. 3), flame is proven. If the current temperature signal plotted against the change in the temperature signal, over the time period, maps below the plotted predetermined criteria, flameout is detected and controller 55 sends a control signal to close control valve 46.

Thermocouples utilize a relationship that when two dissimilar metals are brought into intimate contact, a voltage is developed that depends on the temperature at the junction and the particular metals used. If two such junctions are connected in series with a voltage-measuring device, the measured voltage will be very nearly proportional to the temperature difference of the two junctions.

In one embodiment of the instant invention, type K thermocouples are utilized. The proportionality of a type K thermocouple [reference junction at 32° F.] is as follows: at about 32° F., the thermal electromotive force registered would be about 0 mV; at about 500° F., the thermal electromotive force registered would be about 10 mV; and at about 1000° F., the thermal electromotive force registered would be about 24 mV.

Utilizing this known proportionality, a flameout detection method is developed through controller 55. As shown in FIG. 3, flameout detection criteria is inputted to controller 55, for example by programming into memory of an application specific integrated circuit (ASIC) or other programmable memory device. The flameout detection criteria, as plotted in FIG. 3, is compared by controller 55 to the current thermocouple reading in mV against the change in thermocouple reading over the selected time frame. When an operational mode is selected and ignition is successful, the signals from the thermocouples are monitored. If the sensor is at a relatively low temperature, the thermocouple reading will be relatively low, for example, for a temperature of 250° F. the thermal electromotive force registered would be about 5 mV. If the sensor is at a relatively high temperature, the thermocouple reading will be relatively high, for example, for a temperature of about 750° F. the thermal electromotive force would be about 15 mV.

Now referring to FIG. 3, in this embodiment of the instant invention, if controller 55 detects that temperature sensor 54 is generating a temperature signal between 0 mV to about 5 mV, the oven is in the process of warming up towards the preset temperature ($T_s$). If controller 55 also detects that the change in the temperature signals over that time frame is not increasing at greater than a predetermined ignition rate, for example, the change in temperature signals is greater than +2 mV, flameout is detected, or a successful ignition is not proven.

If controller 55 detects that the thermocouple reading is between about 5 mV to about 15 mV, the sensor temperature is between about 250° F. and 750° F., the typical operating range for both BAKE MODE and BROIL MODE. If controller 55 detects that the change in thermocouple reading is decreasing at greater than a predetermined flameout rate, for example, the change in temperature signal is less than about 0, flameout is detected.

If controller 55 detects that the thermocouple reading is greater than 15 mV, the sensor temperature is greater than 750° F. Accordingly, within this temperature range, the oven temperature is greater than the typical operating range for both BAKE MODE and 750° F. If controller 55 also detects that the change in thermocouple reading is decreasing at greater than a predetermined flame rate, for example, the change in temperature signal is less than −2 mV, flameout is detected.

If the thermocouple signal mapped against the change in thermocouple signal, over the selected time frame, plots above this criteria, flame is detected and controller 55 continues to monitor.

If the system user selects BROIL MODE, a preset temperature ($T_s$) is established, typically in the range between about 550° F. to 800°0 F.

Controller 55 generates a control signal to open control valve 44 such that a flow of gas is established through gas pipe 56 and the flow of gas is issued through broil element 34. Additionally, controller 55 generates an ignition signal to activate ignitor 48 such that a spark or the like is generated by ignitor 48 to ignite the flow of gas issuing through broil element 34.

Controller 55 also receives temperature signals from a conventional oven thermometer 36 (FIG. 1) to monitor the overall oven temperature. If controller 55 (FIG. 2) senses that the oven temperature is greater than or equal to the preset temperature ($T_s$), heating is no longer required and controller 55 generates a control signal to close control valve 44.

In accordance with one embodiment of the instant convention, controller 55 ensures ignition attempts are successful by monitoring the temperature signals generated from temperature sensor 52. If the temperature signals generated by temperature sensor 52 increase at a rate that is greater than a predetermined ignition rate, the ignition attempt is determined to be successful.

In one embodiment, ignition is proven within ten seconds of the opening of control valve 44 by detecting at least 2.0 mV increase in the temperature signals generated by temperature sensor 52. In another embodiment of the instant invention, ignition is proven within 60 seconds of the opening of control valve 44 by detecting at least a 3 degrees Fahrenheit increase in the temperature signals generated by temperature sensor 52.

If the temperature signals sensed by temperature sensor 52 do not increase at a rate that is greater than a predetermined ignition rate, the ignition attempt is determined by controller 55 to have been unsuccessful, controller 55 generates a control signal to close control valve 44, and oven cavity 18 (FIG. 1) is allowed to purge itself during a predetermined time delay before another ignition attempt is made. During the delay, unburned fuel leaves the oven cavity 18, and after the delay the ignition process is begun anew.

If controller 55 (FIG. 2) detects ignition was successful, controller 55 continues to monitor the temperature signals generated by temperature sensor 52 to detect if there is a premature flameout.

Controller 55 detects that there is a premature flameout if either, the temperature signals generated by temperature sensor 52 are decreasing at a rate that is greater than a predetermined flameout rate, or if the temperature signals generated by temperature sensor 52 are increasing at a rate that is less than a predetermined flame rate.

In one embodiment, the temperature signals generated by temperature sensor 52 are monitored at one second intervals. Controller 55 compares each temperature signal to the temperature signal from 14 seconds earlier. The change in the temperature signal is compared with predetermined criteria. If the current temperature signal plotted against the change in the temperature signal, over the time frame, maps above the plotted predetermined criteria, flame is proven. If, however, the current temperature signal plotted against the change in the temperature signal, over the time frame, maps below the plotted predetermined criteria, flameout is detected and controller 55 sends a control signal to close control valve 44.

Figure 4:
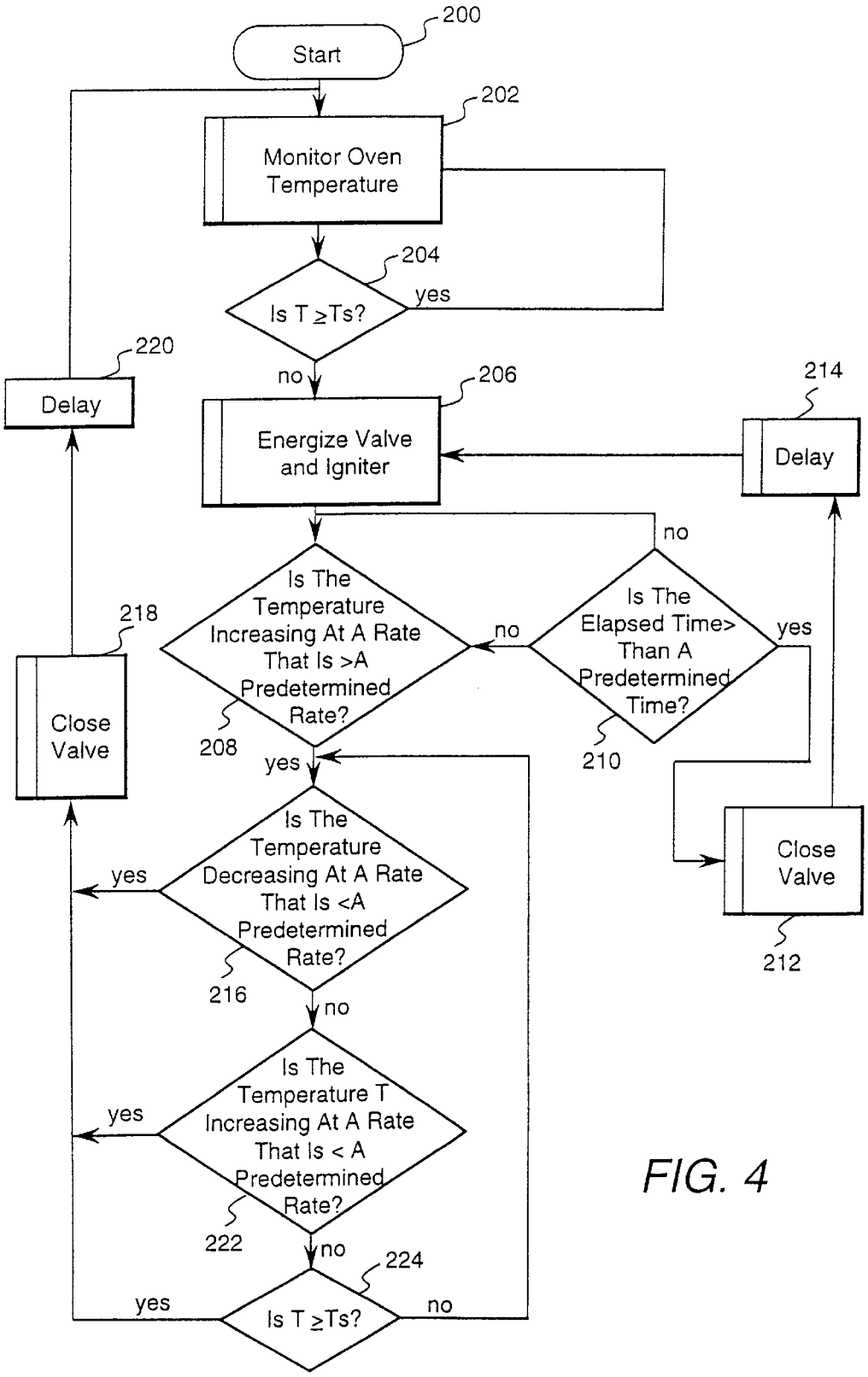
FIG. 4 is an exemplary control logic flowchart in accordance with one embodiment of the instant invention.

An exemplary control logic sequence for gas oven 10 is shown in FIG. 4. A system user initiates the control sequence at block 200 by selecting a mode of operation, for example, BAKE MODE, or BROIL MODE, and a preset temperature ($T_s$) is established.

At block 202, the oven temperature (T) is monitored by controller 55 through oven thermostat 36. The oven temperature is continuously monitored by controller 55 until the mode of operation is turned off, typically by a system user.

Next, at block 204, controller 55 compares the current oven temperature (T) with the preset temperature ($T_s$). If the current oven temperature (T) is greater than or equal to the preset temperature ($T_s$), no further heating is necessary, and the control sequence returns to block 202 and continues to monitor the current oven temperature (T). If, however, the current oven temperature (T) is less than the preset temperature ($T_s$), further heating of the oven is necessary, and the control sequence advances to block 206.

At block 206, controller 54 energizes the appropriate control valve (control valve 42 for bake mode or control valve 52 for broil mode) and the appropriate ignitor (ignitor 50 for bake mode or ignitor 48 for broil mode), such that fuel flow to the appropriate burner is established and ignition is attempted.

Next, at block 208, controller 54 monitors the sensor temperature with the appropriate temperature sensor, bake temperature sensor 56 or broil temperature sensor 58.

If, the sensor temperature is not increasing at a rate that is greater than a predetermined ignition rate, the controller detects that ignition has been unsuccessful and the sequence continues to block 210.

At block 210, controller 55 monitors the elapsed time from when the appropriate valve was opened at block 206. If the elapsed time is less than a predetermined time, for example 10 to 15 seconds, safe operation is ensured and the sequence returns to block 208 to continue the ignition process. If, however, the elapsed time is greater than or equal to a predetermined time, controller 55 generates a control signal to close the appropriate control valve as a safety precaution at block 212.

After the control valve is closed at block 212, the sequence enters a delay stage at block 214 to purge any unburned fuel that has accumulated within oven cavity 18 while the control valve was in an open position. Generally, the delay at block 214 will last in the range between about 15 seconds to about 100 seconds.

Next, after sufficient delay at block 214, the control sequence returns to block 206 where the appropriate valve and ignitor are re-energized and ignition is re-attempted.

If the sensor temperature sensed by the appropriate temperature sensor is increasing at a rate that is greater than a predetermined ignition rate the controller determines ignition has been successful and the sequence continues to block 216.

At block 216, controller 55 monitors the burner for premature flameout. Controller 55 monitors the sensor temperature signals to detect if the temperature signals are decreasing at a rate that is greater than a predetermined flameout rate. If controller 55 detects that the temperature signals are decreasing a rate that is greater than a predetermined flameout rate, flameout is detected and the control valve is closed at block 218, the sequence enters a delay stage at block 220, and after sufficient delay the sequence returns to block 202 to monitor the oven temperature.

If controller 55 detects that the temperature signals are not decreasing at a rate that is greater than a predetermined flameout rate, the sequence advances to block 222.

At block 222, controller 55 continues to monitor the burner for premature flameout. Controller 55 monitors the sensor temperature signals to detect if the temperature signals are increasing at a rate that is less than a predetermined flame rate.

If controller 55 detects that the temperature signals are increasing at a rate that is less than a predetermined flame rate, flameout is detected and control valve is closed a block 218. The sequence enters a delay stage at block 220 and after sufficient delay the sequence returns to block 202 and continues to monitor the current sensor temperature.

If controller 55 detects that the temperature signals are not increasing at a rate that is less than a predetermined flame rate, the sequence advances to block 224.

At block 224, controller 55 compares the current oven temperature (T) with the preset temperature ($T_s$). If the current oven temperature (T) is greater than or equal to the preset temperature ($T_s$), no further heating is necessary, the control valve is closed at block 218, the sequence enters a delay stage at block 220 and after sufficient delay the sequence returns to block 202 and continues to monitor the current oven temperature (T).

If the current oven temperature (T) is not greater than or equal to the preset temperature ($T_s$), further heating is necessary and the sequence returns to block 216 for flameout monitoring. Thus the control sequence of the instant invention is a closed loop which continues until a system user turns off gas oven 10.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A gas oven comprising:

a burner;

a gas valve connected to said burner;

an ignitor situated adjacent said burner;

an indicator of ignition situated to detect temperature in said gas oven; and a controller having an input connected to said indicator of ignition and outputs connected to said gas valve and said ignitor, said controller being responsive to said indicator of ignition so as to cause said gas valve to close whenever oven temperature does not increase at at least a predetermined ignition rate within a first predetermined time after said gas valve is opened.

2. The gas oven of claim 1 wherein said controller is further responsive to said indicator of ignition so as to cause said gas valve to close whenever oven temperature decreases at at least a predetermined flameout rate or increases at less than a predetermined flame rate.

3. The gas oven of claim 2 wherein said first predetermined in the range between about 10 to 15 seconds.

4. The gas oven of claim 2 wherein said ignitor is a high voltage spark ignitor.

5. The gas oven of claim 2 wherein said ignitor is a hot surface ignitor.

6. The gas oven of claim 2 wherein said gas valve is a solenoid valve.

7. The gas oven of claim 2 wherein said controller is an electronic range controller comprising a microprocessor which is programmed to regulate operation of said gas oven in the following manner:

monitoring the gas oven temperature to determine if the oven temperature has reached a preset temperature;

opening the gas valve and energizing the ignitor if the oven temperature has not reached the preset temperature;

attempting to ignite the burner;

monitoring the indicator of ignition for positive proof of burner ignition;

monitoring the indicator of ignition to check for flameout once proof of burner ignition is received from said indicator of ignition; and heating gas oven until the gas oven temperature has reached the preset temperature and returning to the first step of monitoring the gas oven temperature to determine if the oven temperature has reached the preset temperature.

8. The gas oven of claim 7 further comprising the steps of:

monitoring the elapsed time that the gas valve is opened;

closing the gas valve if the indicator of ignition does not detect burner ignition after a predetermined time; and attempting re-ignition after a time delay.

9. The gas oven of claim 1 wherein said indicator of ignition is a conventional oven thermostat.

10. The gas oven of claim 1 wherein said indicator of ignition is a temperature sensor.

11. The gas oven of claim 10 wherein said temperature sensor is a thermocouple.

12. The gas oven of claim 10 wherein said temperature sensor is a resistance temperature device.

13. The gas oven of claim 10 further comprising a conventional oven thermostat, wherein said temperature sensor is the primary indicator of ignition and said conventional oven thermostat is the secondary indicator of ignition.

* * * * *